US007690308B2

(12) United States Patent
Nielson et al.

(10) Patent No.: US 7,690,308 B2
(45) Date of Patent: Apr. 6, 2010

(54) METHODS OF FABRICATING AND IGNITING FLARES INCLUDING REACTIVE FOIL AND A COMBUSTIBLE GRAIN

(75) Inventors: Daniel B. Nielson, Tremonton, UT (US); Richard L. Tanner, Brigham City, UT (US); Carl Dilg, Willard, UT (US)

(73) Assignee: Alliant Techsystems Inc., Edina, MN (US)

( * ) Notice: Subject to any disclaimer, the term of this patent is extended or adjusted under 35 U.S.C. 154(b) by 15 days.

(21) Appl. No.: 12/250,081

(22) Filed: Oct. 13, 2008

(65) Prior Publication Data

US 2009/0117501 A1 May 7, 2009

Related U.S. Application Data

(62) Division of application No. 11/536,574, filed on Sep. 28, 2006, now Pat. No. 7,469,640.

(51) Int. Cl.
*F42B 4/26* (2006.01)

(52) U.S. Cl. ..... 102/336; 102/289; 149/14

(58) Field of Classification Search ..... 102/336–345, 102/205, 275.11, 285–289; 149/2, 14–16; 264/3.1–3.4

See application file for complete search history.

(56) References Cited

U.S. PATENT DOCUMENTS

| | | | |
|---|---|---|---|
| 4,060,435 | A | 11/1977 | Schroeder |
| 4,435,481 | A | 3/1984 | Baldi |
| 4,621,579 | A | 11/1986 | Badura et al. |
| 4,708,913 | A | 11/1987 | Baldi |
| 4,791,870 | A | 12/1988 | Simpson |
| 4,860,657 | A | 8/1989 | Steinicke et al. |
| 5,025,729 | A | 6/1991 | Cameron |

(Continued)

FOREIGN PATENT DOCUMENTS

| | | |
|---|---|---|
| EP | 0271480 B1 | 6/1988 |

(Continued)

OTHER PUBLICATIONS

Barbee, Troy, "NanoFoil Solders with Less Heat," 2005 R&D 100 Awards, S&TR, Oct. 2005, 2 pages.

(Continued)

*Primary Examiner*—Bret Hayes
*Assistant Examiner*—Michael D David
(74) *Attorney, Agent, or Firm*—TraskBritt

(57) ABSTRACT

Flares include grain assemblies comprising a combustible grain and a reactive foil positioned at least proximate to the grain and configured to ignite combustion of the grain upon ignition of the reactive foil. The reactive foil may include alternating layers of reactive materials. Methods of fabricating flares include at least partially covering an exterior surface of a combustible grain with a reactive foil to form a grain assembly, and inserting the grain assembly at least partially into a casing. The reactive foil may include alternating layers of reactive materials that are configured to react with one another in an exothermic chemical reaction upon ignition. Furthermore, methods of igniting a flare grain include initiating an exothermic chemical reaction between alternating layers of reactive materials in a reactive foil located proximate to the flare grain.

18 Claims, 5 Drawing Sheets

U.S. PATENT DOCUMENTS

| | | | |
|---|---|---|---|
| 5,056,435 | A | 10/1991 | Jones et al. |
| 5,400,712 | A | 3/1995 | Herbage et al. |
| 5,413,024 | A | 5/1995 | Plummer |
| 5,467,714 | A | 11/1995 | Lund et al. |
| 5,470,408 | A | 11/1995 | Nielson et al. |
| 5,472,533 | A | 12/1995 | Herbage et al. |
| 5,505,799 | A | 4/1996 | Makowiecki |
| 5,538,795 | A | 7/1996 | Barbee, Jr. et al. |
| 5,547,715 | A | 8/1996 | Barbee, Jr. et al. |
| 5,561,259 | A | 10/1996 | Herbage et al. |
| 5,565,150 | A | 10/1996 | Dillehay et al. |
| H001603 | H | 11/1996 | Deckard et al. |
| 5,661,257 | A | 8/1997 | Nielson et al. |
| 5,679,921 | A | 10/1997 | Hahn et al. |
| 5,773,748 | A | 6/1998 | Makowiecki et al. |
| 5,834,680 | A | 11/1998 | Nielson et al. |
| 5,895,882 | A | 4/1999 | Woodall, Jr. |
| 5,912,430 | A | 6/1999 | Nielson |
| 6,055,909 | A | 5/2000 | Sweeny |
| 6,123,789 | A | 9/2000 | Nielson |
| 6,128,845 | A | 10/2000 | Jacobson |
| 6,170,399 | B1 | 1/2001 | Nielson et al. |
| 6,190,475 | B1 | 2/2001 | Nielson |
| 6,263,797 | B1 | 7/2001 | Brice |
| 6,312,625 | B1 | 11/2001 | Nielson et al. |
| 6,343,564 | B1 | 2/2002 | Miller et al. |
| 6,360,666 | B1 | 3/2002 | Harris |
| 6,412,417 | B1 | 7/2002 | Anderson et al. |
| 6,427,599 | B1 | 8/2002 | Posson et al. |
| 6,432,231 | B1 | 8/2002 | Nielson et al. |
| 6,463,856 | B1 | 10/2002 | Koch |
| 6,484,617 | B1 | 11/2002 | Anderson et al. |
| 6,534,194 | B2 | 3/2003 | Weihs et al. |
| 6,539,869 | B2 | 4/2003 | Knowlton et al. |
| 6,588,343 | B1 | 7/2003 | Mulinix |
| 6,600,002 | B2 | 7/2003 | Sanderson et al. |
| 6,634,301 | B1 | 10/2003 | Mulinix |
| 6,675,716 | B1 | 1/2004 | Nadler |
| 6,679,174 | B1 | 1/2004 | Mulinix |
| 6,736,942 | B2 | 5/2004 | Weihs et al. |
| 6,863,992 | B2 | 3/2005 | Weihs et al. |
| 6,991,855 | B2 | 1/2006 | Weihs et al. |
| 6,991,856 | B2 | 1/2006 | Weihs et al. |
| 7,121,402 | B2 | 10/2006 | Van Heerden et al. |
| 7,278,353 | B2 | 10/2007 | Langan et al. |
| 7,278,354 | B1 | 10/2007 | Langan et al. |
| 2001/0046597 | A1 | 11/2001 | Weihs et al. |
| 2003/0047104 | A1 | 3/2003 | Raz |
| 2004/0011235 | A1 | 1/2004 | Callaway et al. |
| 2004/0060625 | A1 | 4/2004 | Barbee et al. |
| 2004/0149373 | A1 | 8/2004 | Weihs et al. |
| 2004/0149813 | A1 | 8/2004 | Weihs et al. |
| 2004/0247931 | A1 | 12/2004 | Weihs et al. |
| 2005/0003228 | A1 | 1/2005 | Weihs et al. |
| 2005/0051607 | A1 | 3/2005 | Wang et al. |
| 2005/0082343 | A1 | 4/2005 | Wang et al. |
| 2005/0121499 | A1 | 6/2005 | Heerden et al. |
| 2005/0136270 | A1 | 6/2005 | Besnoin et al. |
| 2005/0142495 | A1 | 6/2005 | Van Heerden et al. |
| 2006/0038160 | A1 | 2/2006 | Wood |
| 2006/0042417 | A1 | 3/2006 | Gash et al. |
| 2007/0169657 | A1 | 7/2007 | Kneisl |
| 2007/0169862 | A1 | 7/2007 | Hugus et al. |
| 2007/0295236 | A1 | 12/2007 | Callaway et al. |

FOREIGN PATENT DOCUMENTS

| | | | |
|---|---|---|---|
| EP | 1015401 | B1 | 7/2000 |
| EP | 1032802 | B1 | 11/2003 |
| GB | 2162621 | A | 2/1986 |
| GB | 2266944 | A | 11/1993 |
| GB | 2283559 | A | 5/1995 |
| GB | 2327116 | A | 1/1999 |
| GB | 2354060 | A | 3/2001 |
| GB | 2387430 | A | 10/2003 |
| WO | 0019164 | A1 | 4/2000 |
| WO | 2005005092 | A2 | 2/2005 |
| WO | 2005042240 | A2 | 5/2005 |

OTHER PUBLICATIONS

Granier, John Joseph, "Combustion Characteristics of A1 Nanoparticles and Nanocomposite A1+MoO3 Thermites," Dissertation in Mechanical Engineering submitted to the Graduate Faculty of Texas Tech University, May 2005, 217 pages.

Hwang, Jun-Sik, et al., "A Study on the Factors Affecting the Firing Sensitivity of Exploding Foil Initiator," presented at the 31st International Pyrotechnics Seminar, The Major International Forum for Pyrotechnics, 2004.

Koch, Ernst-Christian, "Pyrotechnic Countermeasures: II. Advanced Aerial Infrared Countermeasures," Propellants, Explosives, Pyrotechnics 31, No. 1, 2006, pp. 3-19.

RNT Reactive NanoTechnologies Website, 2005 All Rights Reserved, http://www.rntfoil.com/applications/energetics/markets.html, 1 page.

METHODS OF FABRICATING AND IGNITING FLARES INCLUDING REACTIVE FOIL AND A COMBUSTIBLE GRAIN

CROSS-REFERENCE TO RELATED APPLICATION

This application is a divisional of U.S. patent application Ser. No. 11/536,574, filed Sep. 28, 2006, now U.S. Pat. No. 7,469,640, issued Dec. 30, 2008, the disclosure of which is incorporated herein by reference in its entirety.

FIELD OF THE INVENTION

The present invention, in various embodiments, relates to pyrotechnic flares for use in signaling, illumination, defensive countermeasures, or a combination of several such functions. The present invention also relates to methods of fabricating and igniting such pyrotechnic flares.

BACKGROUND OF THE INVENTION

Flares are pyrotechnic devices designed to emit intense electromagnetic radiation at wavelengths in the visible region (i.e., light), the infrared region (i.e., heat), or both, of the electromagnetic radiation spectrum without exploding or producing an explosion. Conventionally, flares have been used for signaling, illumination, and defensive countermeasures in both civilian and military applications.

Flares produce their electromagnetic radiation through the combustion of a primary pyrotechnic material that is conventionally referred to as the "grain" of the flare. The grain conventionally includes magnesium and fluoropolymer-based materials. Adding additional metals or other elements to the primary pyrotechnic material may alter the peak emission wavelength emitted by the flare.

Decoy flares are one particular type of flare used in military applications for defensive countermeasures. Decoy flares emit intense electromagnetic radiation at wavelengths in the infrared region of the electromagnetic radiation spectrum and are designed to mimic the emission spectrum of the exhaust of a jet engine on an aircraft.

Many conventional anti-aircraft heat-seeking missiles are designed to track and follow an aircraft by detecting the infrared radiation emitted from the jet engine or engines of the aircraft. As a defensive countermeasure, decoy flares are launched from an aircraft being pursued by a heat-seeking missile. When an aircraft detects that a heat-seeking missile is in pursuit of the aircraft, one or more decoy flares may be launched from the aircraft. The heat-seeking missile may, thus, be "decoyed" into tracking and following the decoy flare instead of the aircraft.

Conventional decoy flares include an elongated, generally cylindrical grain that is inserted into a casing. The casing may have a first, aft end from which the decoy flare is ignited and a second, opposite forward end from which the grain is projected upon ignition. The generally cylindrical grain can include grooves or other features that extend longitudinally along the exterior surface thereof to increase the overall surface area of the grain.

The ignition system of a decoy flare conventionally includes an impulse charge device positioned within the casing adjacent the aft end thereof, and a piston-like member positioned between the impulse charge device and the grain. The ignition system may further include a first igniter material positioned on the side of the piston-like member adjacent the impulse charge device, and a second igniter material on the side of the piston-like member adjacent the grain. This second igniter material (often referred to as "first-fire" material) may surround the grain and may be disposed within the longitudinally extending grooves of the grain.

The impulse charge device may be ignited by, for example, an electrical signal. Upon ignition, the impulse charge device may explode or cause an explosion. The expanding gasses generated by the explosion force the piston-like member and the grain out from the second end of the casing, and the explosion may further substantially simultaneously ignite combustion of the first ignition material. The piston-like member may include a mechanism that causes or allows the first igniter material to ignite combustion of the second igniter material after the piston-like member and the grain have been deployed from the casing by the impulse charge device. The combustion of the second igniter material ignites combustion of the grain itself.

By increasing the surface area of the grain, the surface area of the interface between the second igniter material (i.e., first-fire material) and the grain may be increased, enhancing the efficiency by which the second igniter material ignites combustion of the grain.

Conventional igniter materials used as the second igniter material (i.e., first-fire material) in decoy flares conventionally include combustible powders, slurries, and sol-gel compositions.

Flares are extremely dangerous and the ability to safely fabricate and use flares is a constant challenge to those working in the art. Furthermore, the incorporation of safety features or elements into flare designs has, in some cases, detrimentally affected the reliability of the decoys and caused an increase in the number of decoys that fail to properly and fully ignite. There is an ongoing need in the art for flares that are easier and safer to fabricate and that have increased ignition reliability.

BRIEF SUMMARY OF THE INVENTION

In one embodiment, the present invention includes a flare having a grain assembly comprising a combustible grain and a reactive foil positioned at least proximate to the grain and configured to ignite combustion of the grain upon ignition of the reactive foil. The reactive foil may include alternating layers of reactive materials. Optionally, the reactive foil may be, or include, a reactive nanofoil and the average thickness of each of the alternating layers of reactive materials may be less than about 100 nanometers.

In another embodiment, the present invention includes a method of fabricating a flare. The method includes at least partially covering an exterior surface of a combustible grain with a reactive foil to form a grain assembly, and inserting the grain assembly at least partially into a casing. The reactive foil may include alternating layers of reactive materials that are configured to react with one another in an exothermic chemical reaction upon ignition.

In yet another embodiment, the present invention includes a method of igniting a flare grain. The method includes igniting a reactive foil located proximate to the flare grain to initiate an exothermic chemical reaction between alternating layers of reactive materials in the reactive foil.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Figure 1A:
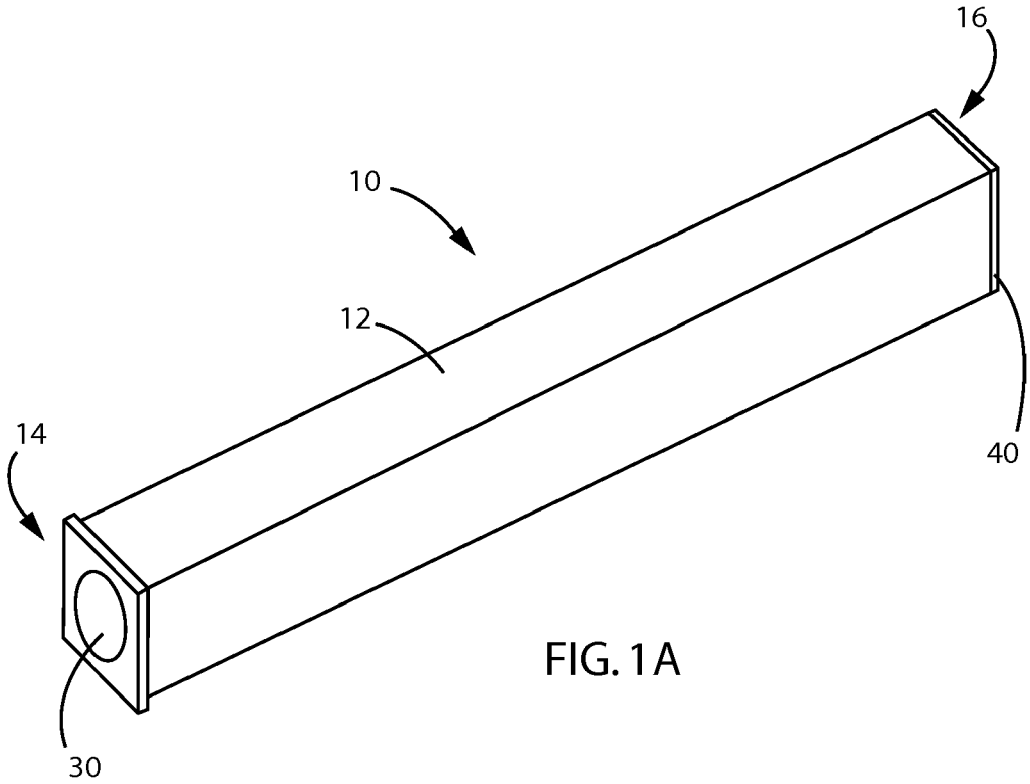
FIG. 1A is a perspective view of one example of a flare that embodies teachings of the present invention.
Figure 1B:
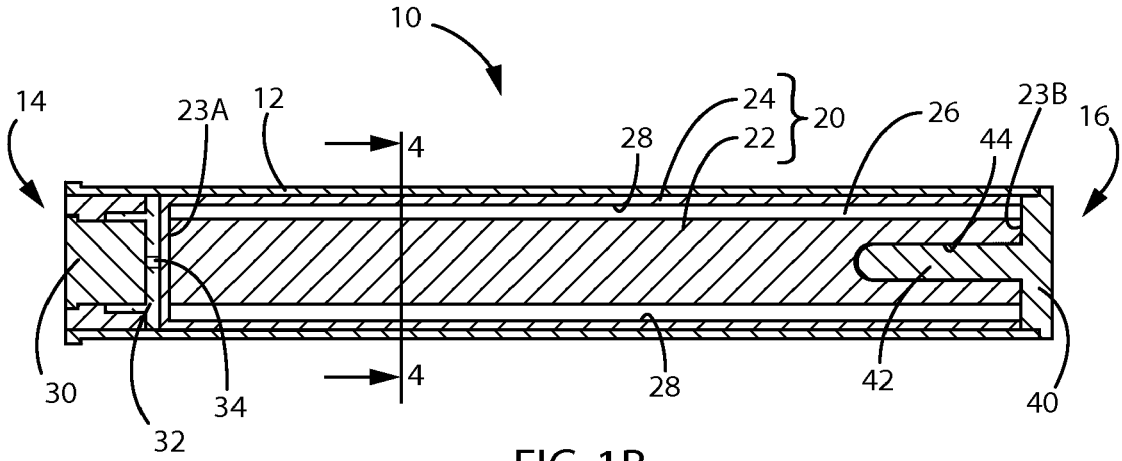
FIG. 1B is a cross-sectional view of the flare shown in FIG. 1A.

One example of a flare 10 that embodies teachings of the present invention is shown in FIGS. 1A and 1B. The flare 10 includes a grain assembly 20 (FIG. 1B), which may be disposed within a casing 12. The grain assembly 20 includes a grain 22 of combustible material and a reactive foil 24 that is positioned relative to the grain 22 and configured to ignite combustion of the grain 22 upon ignition of the reactive foil 24. As will be discussed in further detail below, the reactive foil 24 may include alternating layers of different materials that are configured to react with one another in an exothermic chemical reaction upon ignition, which exothermic chemical reaction may be used to ignite combustion of the grain 22.

In some embodiments of the present invention, the flare 10 may be configured as a decoy flare, and the combustible material of the grain 22 may be configured to emit electromagnetic radiation (upon combustion of the grain 22) having a peak emission wavelength within the infrared region of the electromagnetic radiation spectrum (i.e., between about 0.7 micron and about 100 microns). In additional embodiments, the flare 10 may be configured for signaling, illumination, or both, and may be configured to emit a peak emission wavelength within the visible region of the electromagnetic radiation spectrum (i.e., between about 400 nanometers and about 700 nanometers). In yet other embodiments, the flare 10 may be configured to emit a peak emission wavelength within the ultraviolet region of the electromagnetic radiation spectrum.

As shown in FIGS. 1A and 1B, in some embodiments of the present invention, both the grain 22 of the grain assembly 20 and the casing 12 may have an elongated shape. The casing 12 may have a first, aft end 14 and a second, opposite forward end 16. An impulse charge device 30 may be provided at or within the first end 14 of the casing 12 although, in some embodiments, such an impulse charge device 30 may not be coupled to the flare 10 until the flare 10 is ready to be deployed (e.g., if the flare 10 includes a decoy flare, the impulse charge device 30 may not be coupled to the flare 10 until the flare 10 is mounted in an aircraft). The impulse charge device 30 may be configured to force the grain assembly 20 out from the second end 16 of the casing 12 upon ignition of the impulse charge device 30. As shown in FIG. 1B, the decoy flare 10 may include a piston member 32 disposed within the casing 12 between the impulse charge device 30 and the grain assembly 20.

In some embodiments of the present invention, the piston member 32 may be part of an ignition assembly (often referred to in the art as an "ignition sequence assembly," a "safe and arm igniter," or a "safe and arm ignition assembly"). In some embodiments, the flare 10 may include an ignition assembly having a mechanism configured to prevent ignition of the reactive foil 24 and the grain 22 until the grain assembly 20 has been substantially ejected from the casing 12 by the impulse charge device 30. One example of such a mechanism is disclosed in, for example, U.S. Pat. No. 5,561,259 to Herbage et al., the entire disclosure of which is hereby incorporated herein by this reference. In other embodiments, the flare 10 may include an ignition assembly that is configured to cause ignition of the reactive foil 24 and the grain 22 before the grain assembly 20 has been substantially ejected from the casing 12 by the impulse charge device 30, or as the grain assembly 20 is being ejected from the casing 12 by the impulse charge device 30. By way of example and not limitation, the ignition assembly may include a pellet 34 of combustible material that is attached or coupled to the piston member 32. The pellet 34 may include, for example, a boron- or magnesium-based material. Combustion of the pellet 34 may be initiated upon ignition of the impulse charge device 30, and combustion of the pellet 34 may cause ignition of the grain assembly 20.

As shown in FIG. 1B, the grain 22 may include an aft end 23A and a forward end 23B. The flare 10 may further include an end cap 40 proximate to the forward end 23B of the grain 22. In some embodiments, the end cap 40 may include an elongated rod 42 that is configured to be inserted into an internal bore 44 within the grain 22.

Figure 2A:
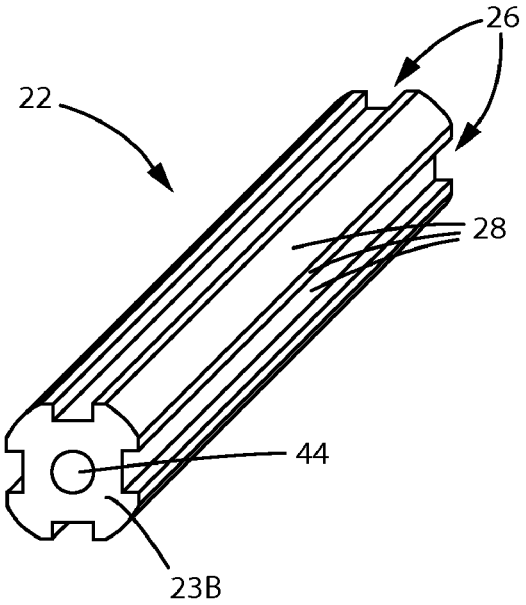
FIG. 2A is a perspective view of one example of a grain that may be used in a flare that embodies teachings of the present invention, such as the flare shown in FIGS. 1A and 1B.
Figure 2B:
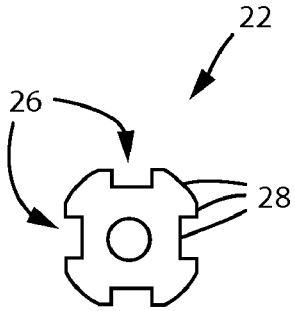
FIG. 2B is an end view of the grain shown in FIG. 2A.

FIG. 2A is a perspective view of the grain 22 of the grain assembly 20 shown in FIG. 1B. As shown in FIG. 2A, the grain 22 may be elongated and may include one or more grooves 26 that are defined by one or more of the exterior lateral surfaces 28 of the grain 22. By way of example and not limitation, in some embodiments, the grain 22 may be generally cylindrical in shape. FIG. 2B is an end view of the grain 22 shown in FIG. 2A. As shown in FIG. 2B, the grain 22 may include four grooves 26 defined by the exterior lateral surfaces 28 of the grain 22. Furthermore, the grooves 26 may be circumferentially positioned about the longitudinal axis of the grain 22 and circumferentially spaced about the longitudinal axis approximately equidistant from one another.

Figure 3A:
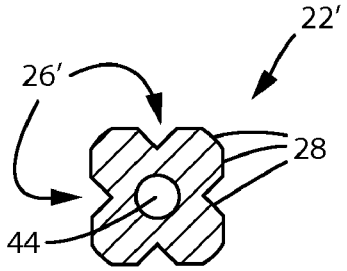
FIGS. 3A-3C illustrate additional examples of grains that may be used in flares that embody teachings of the present invention, such as the flare shown in FIGS. 1A and 1B.
Figure 3B:
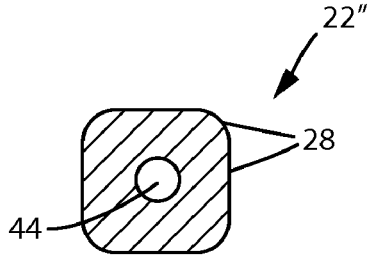
Figure 3C:
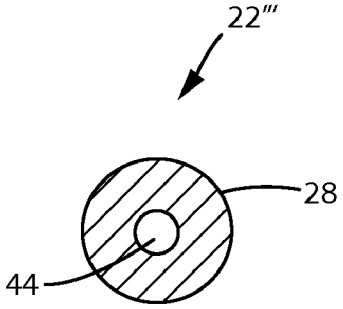

Flares that embody teachings of the present invention may include grains having any configuration, and are not limited to the configuration of the grain 22 shown in FIGS. 2A and 2B. FIG. 3A is a cross-sectional view of another grain 22' that may be used in flares that embody teachings of the present invention, such as, for example, the flare 10 shown in FIGS. 1A and 1B. The grain 22' has a generally rectangular cross-sectional shape and includes four grooves 26' each having a generally triangular cross-sectional shape and being defined by the exterior lateral surfaces 28 of the grain 22'. FIG. 3B is a cross-sectional view of another grain 22" that may be used in flares that embody teachings of the present invention, such as, for example, the flare 10 shown in FIGS. 1A and 1B. The grain 22" also has a generally rectangular cross-sectional shape. The exterior lateral surfaces 28 of the grain 22", however, do not define any grooves in the grain 22" (such as, for example, the grooves 26 shown in FIG. 2B or the grooves 26' shown in FIG. 3A). FIG. 3C is a cross-sectional view of yet another grain 22'" that may be used in flares that embody teachings of the present invention, such as, for example, the flare 10 shown in FIGS. 1A and 1B. The grain 22'" has a generally circular cross-sectional shape, and the exterior lateral surfaces 28 of the grain 22" do not define any grooves in the grain 22'". Furthermore, in some embodiments, the grains 22, 22', 22", and 22'" may not have an elongated shape, and may not include an internal bore 44.

Figure 4:
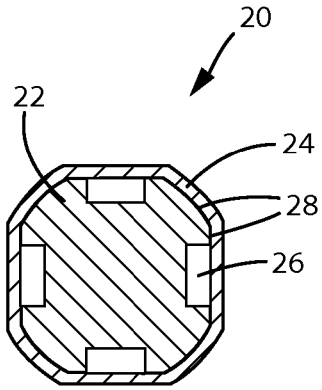
FIG. 4 illustrates one example of a grain assembly that embodies teachings of the present invention and that may be used in flares that embody teachings of the present invention, such as the flare shown in FIGS. 1A and 1B.
Figure 5:
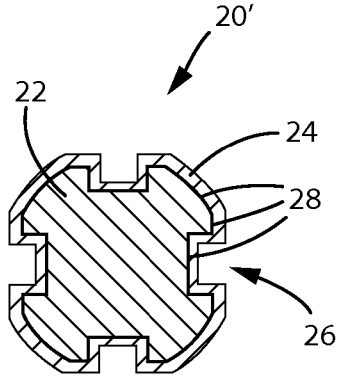
FIG. 5 illustrates another example of a grain assembly that embodies teachings of the present invention and that may be used in flares that embody teachings of the present invention, such as the flare shown in FIGS. 1A and 1B.

FIG. 4 is a cross-sectional view of the grain assembly 20 of the flare 10 shown in FIGS. 1A and 1B taken along section line 4-4 in FIG. 1B. As shown in FIG. 4, in some embodiments, at least a portion of the reactive foil 24 may be in direct physical contact with and cover at least a portion of the grain 22. In other words, the reactive foil 24 may be in direct physical contact with at least a portion of at least one exterior lateral surface 28 of the grain 22. In some embodiments, the reactive foil 24 may cover greater than about fifty percent (50%) of the entire external surface area of the grain 22. Furthermore, the reactive foil 24 may not be in direct physical contact with exterior lateral surfaces 28 of the grain 22 that define the grooves 26. In additional embodiments, however, the reactive foil 24 may be in direct physical contact with and cover each exterior lateral surface 28 of the grain 22, as shown in the grain assembly 20' illustrated in FIG. 5. As shown in FIG. 5, the reactive foil 24 may substantially conform to the exterior lateral surfaces 28 of the grain 22, including the exterior lateral surfaces 28 of the grain 22 that define any grooves 26 therein. In yet other embodiments, the reactive foil 24 may not be in direct physical contact with any surface of the grain 22, but merely positioned proximate to the grain 22 such that combustion of the reactive foil 24 ignites combustion of the grain 22.

Figure 6:
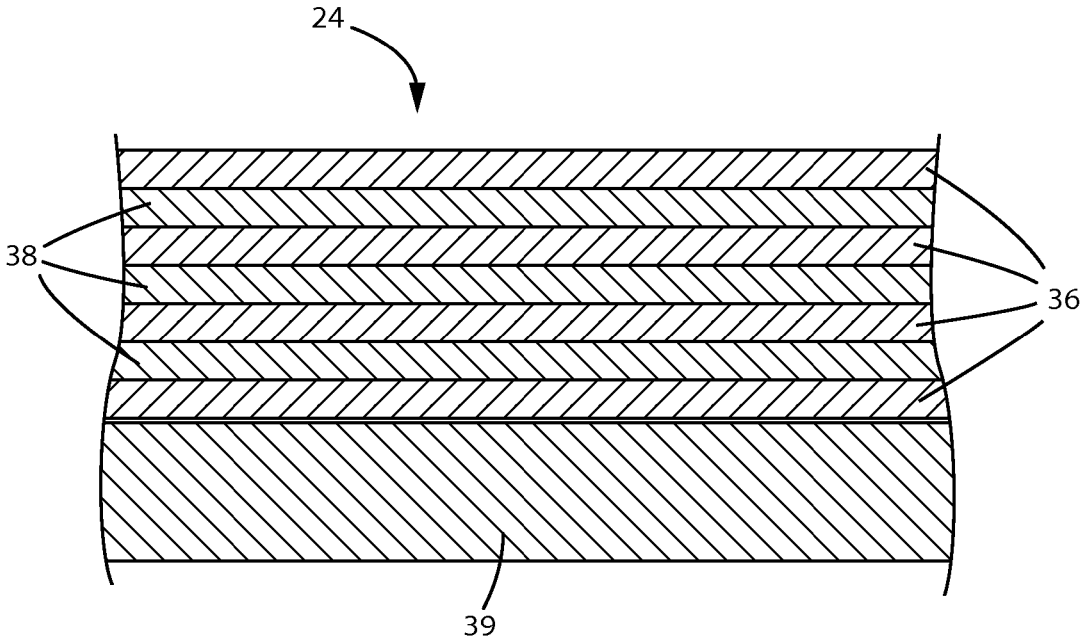
FIG. 6 is a cross-sectional view of one example of a reactive foil material that may be used in grain assemblies and flares that embody teachings of the present invention.

As previously mentioned, the reactive foil 24 may include alternating layers of materials that are configured to react with one another in an exothermic chemical reaction upon ignition, and this exothermic chemical reaction may be used to ignite combustion of the grain 22. FIG. 6 is a cross-sectional view of one example of a reactive foil 24 that may be used in flares that embody teachings of the present invention, such as, for example, the flare 10 shown in FIGS. 1A and 1B. By way of example and not limitation, at least a portion of the reactive foil 24 may include alternating layers of a first material 36 and a second material 38. Optionally, at least a portion of the alternating layers of the first material 36 and the second material 38 may be carried by a substrate material 39, such as, for example, a layer comprising a metal or a metal alloy (e.g., an aluminum-based alloy). By way of example and not limitation, the first material 36 may include a first element in substantially elemental form, and the second material 38 may include an aluminide, boride, carbide, oxide, or silicide of a second, different element. Furthermore, the exothermic chemical reaction that occurs between the first material 36 and the second material 38 during combustion of the reactive foil 24 may result in the formation of an aluminide, boride, carbide, oxide, or silicide of the first element, and may substantially reduce the second, different element from the aluminide, boride, carbide, oxide, or silicide form to elemental form. In one particular embodiment, set forth merely as an example, the first material 36 may include aluminum in substantially elemental form, and the second material 38 may include at least one of iron oxide, copper oxide, and zinc oxide.

The velocity, temperature, and energy of the exothermic chemical reaction between the layers of the first material 36 and the layers of the second material 38 may be selectively controlled by selectively controlling the composition of the first material 36 and the second material 38, and by selectively controlling the average thickness of the individual layers of the first material 36 and the individual layers of the second material 38.

In some embodiments of the present invention, the reactive foil 24 may include a reactive nanofoil comprising alternating layers of reactive materials (e.g., alternating layers of the first material 36 and the second material 38) that each has an average thickness of less than about 100 nanometers.

Some reactive foils that may be used in flares that embody teachings of the present invention, such as, for example, the flare 10 shown in FIGS. 1A and 1B, are commercially available from, for example, Reactive NanoTechnologies, Inc. of Hunt Valley, Md.

One example of a method that may be used to apply the reactive foil 24 to the grain 22 shown in FIGS. 2A and 2B is described below with reference to FIGS. 7 and 8.

Figure 7:
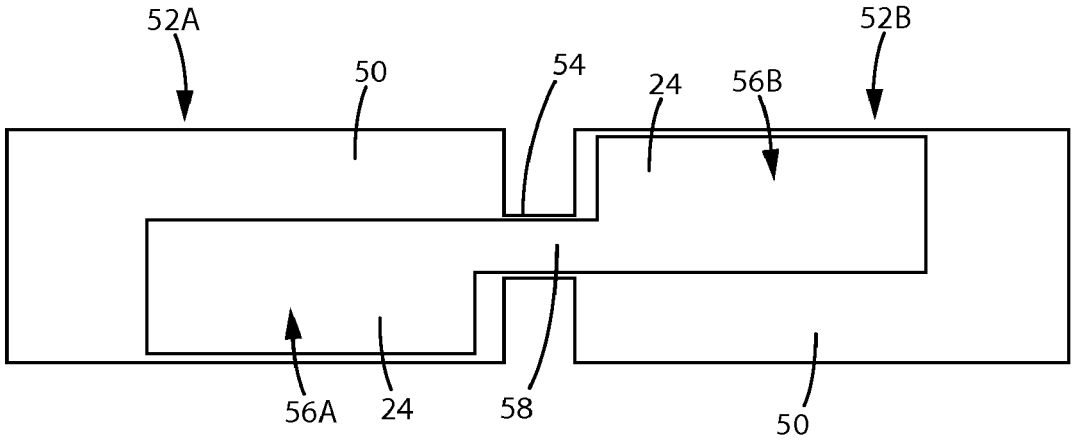
FIG. 7 illustrates one example of a reactive foil configuration that may be used in grain assemblies and flares that embody teachings of the present invention.

Referring to FIG. 7, a first generally rectangular panel or sheet 52A of a carrier material 50 and a second generally rectangular panel or sheet 52B of a carrier material 50 may be provided. The carrier material 50 may include at least one of a layer of metal or metal alloy, a layer of polymer material, and a layer of composite material. In one particular embodiment, set forth merely as an example, the carrier material 50 may include an adhesive-backed composite tape comprising a polymer-impregnated woven nylon fabric. Such adhesive-backed composite tape materials are commercially available from, for example, Bron Tapes Incorporated of Denver, Colo.

Optionally, the first sheet 52A and the second sheet 52B of carrier material 50 may be integrally formed with one another and connected via an integral bridge region 54, as shown in FIG. 7. A first generally rectangular panel or sheet 56A comprising reactive foil 24 (FIG. 6) may be placed over at least a portion of the first sheet 52A of carrier material 50, and a second generally rectangular panel or sheet 56B comprising reactive foil 24 (FIG. 6) may be placed over at least a portion of the second sheet 52B of carrier material 50. Optionally, the first sheet 56A and the second sheet 56B of reactive foil 24 may be integrally formed with one another and connected via an integral bridge region 58 that also includes reactive foil 24.

Although not shown in FIG. 7, in some embodiments, the bridge region 58 of reactive foil 24 and/or the bridge region 54 of carrier material 50 may include one or more apertures extending therethrough for cooperation with features of an ignition assembly, such as, for example, the piston member 32 and/or the pellet 34 (FIG. 1B).

In additional embodiments, the assembly may not include a bridge region 58 of reactive foil 24 that extends between the first sheet 56A and the second sheet 56B of reactive foil 24 or a bridge region 54 of carrier material 50. In yet other embodiments, the bridge region 58 of reactive foil 24 may include a discrete piece of reactive foil 24 that is adhered or otherwise reactively coupled to both the first sheet 56A and the second sheet 56B of reactive foil 24, as opposed to being integrally formed with the first sheet 56A and the second sheet 56B of reactive foil 24.

Figure 8:
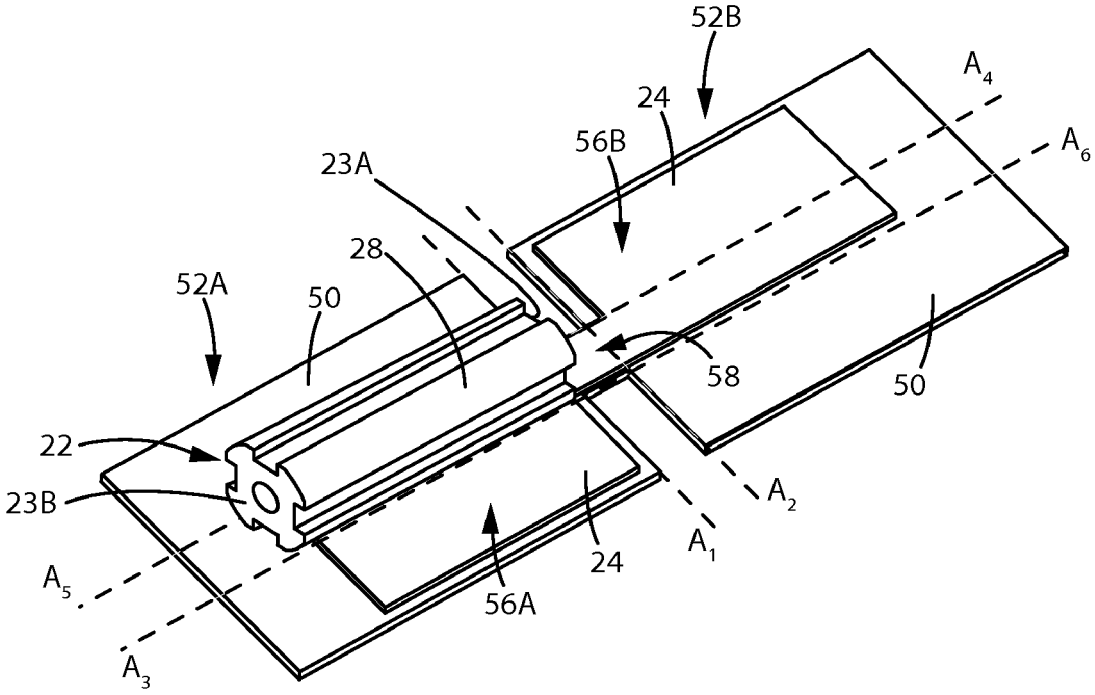
FIG. 8 illustrates one example of a method that embodies teachings of the present invention and that may be used to fabricate grain assemblies and flares that embody teachings of the present invention.

Referring to FIG. 8, the grain 22 may be placed over the first sheet 56A of reactive foil 24. The carrier material 50 then may be folded along the axis $A_1$ such that the bridge region 58 of reactive foil 24 abuts against and covers the aft end 23A of the grain 22. The carrier material 50 may be folded along the axis $A_2$ such that the second sheet 56B of reactive foil 24 is disposed adjacent and covers one or more of the exterior lateral surfaces 28 of the grain 22. The first sheet 52A of carrier material 50 may be folded along the axis $A_3$ such that the first sheet 56A of reactive foil 24 is wrapped around and covers one or more exterior lateral surfaces 28 of the grain 22, and the second sheet 52B of carrier material 50 may be folded along the axis $A_4$ such that the second sheet 56B of reactive foil 24 is wrapped around and covers one or more exterior lateral surfaces 28 of the grain 22. The first sheet 52A of carrier material 50 then may be folded along the axis $A_5$ such that the exposed regions of the first sheet 52A of carrier material 50 (those regions that are not covered by the reactive foil 24) are wrapped around and adhered to the grain 22 using the adhesive of the carrier material 50 (or other adhesive). Similarly, the second sheet 52B of carrier material 50 may be folded along the axis $A_6$ such that the exposed regions of the second sheet 52B of carrier material 50 are wrapped around and adhered to the grain 22 using the adhesive of the carrier material 50 (or other adhesive). The portion of the first and second sheets 52A, 52B of carrier material 50 that extend longitudinally beyond the forward end 23B of the grain 22 may be trimmed and/or folded over the grain 22 as necessary or desired.

Upon ignition of the impulse charge device 30 shown in FIG. 1B, combustion of the pellet 34 may be initiated. Combustion of the pellet 34 in turn initiates combustion of the bridge region 58 (FIG. 8) of the reactive foil 24 either before the grain assembly 20 is deployed from the casing 12, while the grain assembly 20 is being deployed from the casing 12, or after the grain assembly 20 is deployed from the casing 12. As combustion of the reactive foil 24 propagates in a direction extending from the aft end 23A of the grain 22 generally towards the forward end 23B of the grain 22, the exothermic chemical reaction occurring between the alternating layers of reactive material 36, 38 (FIG. 6) within the reactive foil 24 ignites combustion of the grain 22.

Figure 9A:
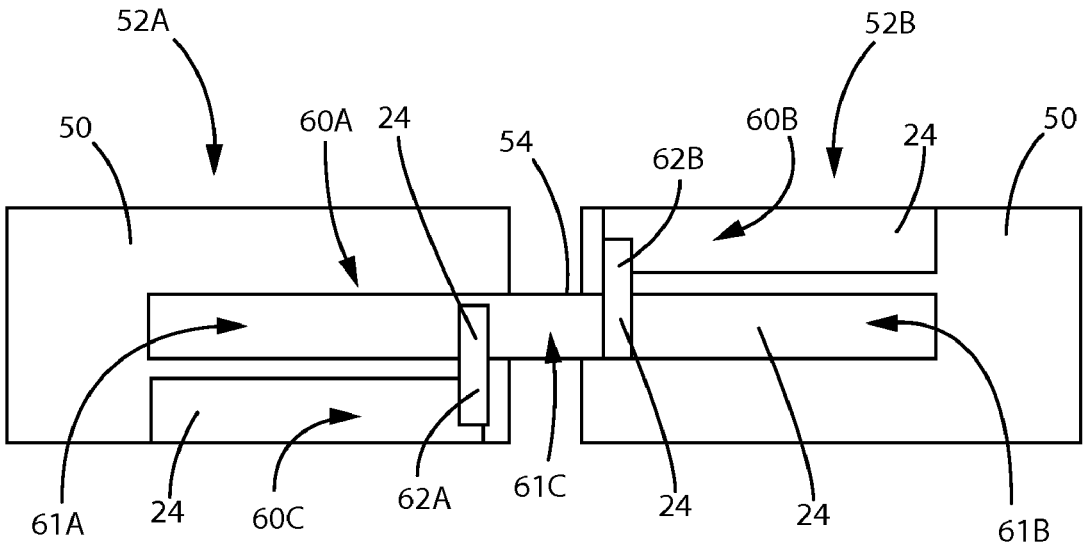
FIGS. 9A and 9B illustrate additional examples of reactive foil configurations that may be used in grain assemblies and flares that embody teachings of the present invention.
Figure 9B:
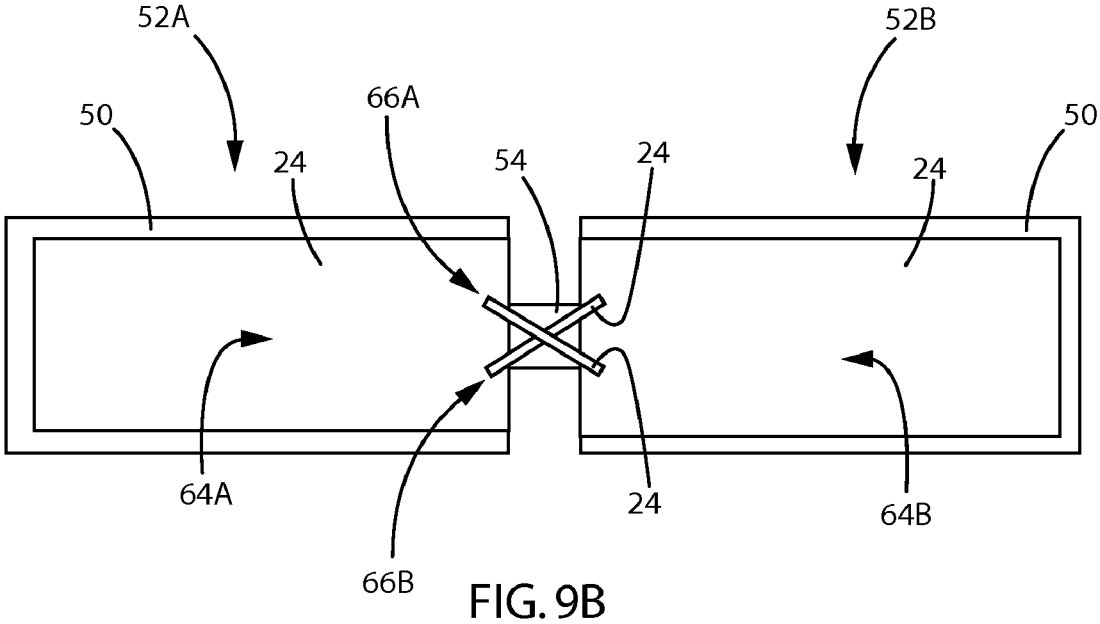

A vast number of reactive foil configurations may be used to fabricate grain assemblies and flares that embody teachings of the present invention. FIGS. 9A and 9B illustrate two additional examples of such reactive foil configurations.

Referring to FIG. 9A, a first generally rectangular panel or sheet 52A of carrier material 50 and a second generally rectangular panel or sheet 52B of carrier material 50 may be provided, as previously described herein in relation to FIG. 7. Optionally, the first sheet 52A and the second sheet 52B of carrier material 50 may be integrally formed with one another and connected via an integral bridge region 54 extending therebetween (the integral bridge region 54 is not visible in FIG. 9A, since the bridge region 54 extends underneath the central region 61C of the first strip 60A of reactive foil 24). A first end 61A of an elongated first strip 60A of reactive foil 24 may be placed over at least a portion of the first sheet 52A, and a second, opposite end 61B of the first strip 60A of reactive foil 24 may be placed over at least a portion of the second sheet 52B of carrier material 50. A central region 61C of the first strip 60A of reactive foil 24 may extend across the bridge region 54 of carrier material 50, as shown in FIG. 9A. An elongated second strip 60B of reactive foil 24 may be placed over another portion of the second sheet 52B of carrier material 50 adjacent the second end 61B of the first strip 60A of reactive foil 24, and an elongated third strip 60C may be placed over another portion of the first sheet 52A of carrier material 50 adjacent the first end 61A of the first strip 60A of reactive foil 24. The second and third strips 60B, 60C of reactive foil 24 may extend generally parallel to the first strip 60A of reactive foil 24, as shown in FIG. 9A. A first relatively smaller discrete strip 62A of reactive foil 24 may be used to reactively couple the third strip 60C of reactive foil 24 to the first strip 60A of reactive foil 24 at a location proximate to the aft end 23A of the grain 22 (FIG. 8). Similarly, a second relatively smaller discrete strip 62B of reactive foil 24 may be used to reactively couple the second strip 60B of reactive foil 24 to the first strip 60A of reactive foil 24 at a location also proximate to the aft end 23A of the grain 22 (FIG. 8).

As previously discussed, ignition of the impulse charge device 30 initiates combustion of the pellet 34 (FIG. 1B). In the configuration shown in FIG. 9A, combustion of the pellet 34 (FIG. 1B) in turn initiates combustion of the central region 61C of the first strip 60A of reactive foil 24 that is disposed over the aft end 23A of the grain 22 (FIG. 1B). Combustion of the first strip 60A of reactive foil 24 may initiate combustion of the first and second relatively smaller discrete strips 62A, 62B of reactive foil 24, which in turn may initiate combustion of the second and third strips 60B, 60C of reactive foil 24. As combustion of the first, second, and third strips 60A, 60B, and 60C of reactive foil 24 propagates in a direction extending from the aft end 23A of the grain 22 generally towards the forward end 23B of the grain 22 (FIG. 1B), the exothermic chemical reaction occurring between the alternating layers of reactive material 36, 38 (FIG. 6) within the reactive foil 24 ignites combustion of the grain 22.

In additional embodiments, the first, second, and third strips 60A, 60B, 60C of reactive foil 24 and the relatively smaller discrete strips 62A, 62B of reactive foil 24 may be integrally formed with one another and cut from a single sheet of reactive foil 24.

In the reactive foil configuration illustrated in FIG. 9A, the first end 61A of the first strip 60A of reactive foil 24, the second end 61B of the first strip 60A of reactive foil 24, the second strip 60B of reactive foil 24, and the third strip 60C of reactive foil 24 each may be sized and configured to cover approximately one-fourth of the exterior lateral surfaces 28 of the grain 22 (FIG. 8).

Referring to FIG. 9B, as in the previously described reactive foil configurations, a first generally rectangular panel or sheet 52A of carrier material 50 and a second generally rectangular panel or sheet 52B of carrier material 50 may be provided. Optionally, the first sheet 52A and the second sheet 52B of carrier material 50 may be integrally formed with one another and connected via an integral bridge region 54, as also previously described. A first panel or sheet 64A of reactive foil 24 may be attached to the first sheet 52A of carrier material 50, and a second panel or sheet 64B of reactive foil 24 may be attached to the second sheet 52B of carrier material 50. Reactive foil 24 also may be provided over the bridge region 54 of carrier material 50. The reactive foil 24 provided over the bridge region 54 of carrier material 50 may have a cross shape, as shown in FIG. 9B. By way of example and not limitation, a first discrete strip 66A of reactive foil 24 and a second discrete strip 66B of reactive foil 24 may be formed into a cross shape and positioned over the bridge region 54 of carrier material 50. In this configuration, the first and second discrete strips 66A, 66B of reactive foil 24 may be used to reactively couple the first sheet 64A of reactive foil 24 to the second sheet 64B of reactive foil 24 at a location proximate to the aft end 23A of the grain 22 (FIG. 8).

As previously discussed, ignition of the impulse charge device 30 initiates combustion of the pellet 34 (FIG. 1B). In the configuration shown in FIG. 9B, combustion of the pellet 34 in turn initiates combustion of the first and second discrete strips 66A, 66B of reactive foil 24 disposed over the aft end 23A of the grain 22. Combustion of the first and second discrete strips 66A, 66B of reactive foil 24 initiates combustion of the first and second sheets 64A, 64B of reactive foil 24. As combustion of the first and second sheets 64A, 64B of reactive foil 24 propagates in a direction extending from the aft end 23A of the grain 22 generally towards the forward end 23B of the grain 22, the exothermic chemical reaction occurring between the alternating layers of reactive material 36, 38 (FIG. 6) within the reactive foil 24 initiates combustion of the grain 22.

In additional embodiments, the first and second panels 64A, 64B of reactive foil 24 and the first and second discrete strips 66A, 66B of reactive foil 24 may be integrally formed with one another and cut from a single sheet of reactive foil 24. Furthermore, in additional embodiments, the reactive foil configuration shown in FIG. 9B may not include the first and second discrete strips 66A, 66B of reactive foil 24.

In the reactive foil configuration illustrated in FIG. 9B, the first sheet 64A of reactive foil 24 may be configured to wrap around at least one-half of the surface area of the exterior lateral surfaces 28 of the grain 22 (FIG. 8), and the second sheet 64B of reactive foil 24 may be configured to wrap around at least the opposite one-half of the surface area of the exterior lateral surfaces 28 of the grain 22 (FIG. 8).

In additional embodiments, the grain 22 (FIG. 8) may be at least partially covered by, or wrapped directly in, reactive foil 24 without using any carrier material 50 for carrying the reactive foil 24. Furthermore, in each of the above-described embodiments, the reactive foil 24 is formed separately from the grain 22 and subsequently attached or positioned proximate to the grain 22.

The various embodiments of reactive foil configurations that embody teachings of the present invention are virtually limitless, and the present invention is not limited to the reactive foil configurations illustrated and described herein.

Referring again to FIG. 1B, to ignite a flare 10 that embodies teachings of the present invention, an exothermic chemical reaction between the alternating layers of reactive material 36, 38 of the reactive foil 24 that at least partially surrounds or covers the grain 22 is initiated. By way of example and not limitation, this exothermic chemical reaction may be initiated in a portion of the reactive foil 24 located proximate to the aft end 23A of the grain 22 by combustion of a pellet 34 of combustible material in an ignition assembly. As previously described, the exothermic chemical reaction of the reactive foil 24 may be used to ignite the combustible material of the grain 22. In additional embodiments, the exothermic chemical reaction in the reactive foil 24 may be initiated by means other than a pellet 34 of combustible material, and the exothermic chemical reaction may be initiated at more than one location in the reactive foil 24.

The use of powder, slurry, and/or sol-gel first-fire materials in flares may be eliminated by utilizing reactive foils to ignite the grains of flares as described herein. The use of reactive foils instead of, or in addition to, conventional first-fire materials may enhance safety during fabrication of flares, improve ignition reliability of flares, and eliminate or reduce the use of environmentally toxic solvents used to prepare conventional first-fire materials. In addition, it is not uncommon for conventional first-fire materials to break or flake away from the grain when the grain is deployed into a wind stream environment, such as that occurring when a decoy flare is deployed behind an aircraft. The reactive foil, used as described herein, may be less likely to break or flake away from the grain under such conditions, thereby improving the effectiveness of flares generally configured as currently known in the art.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method of fabricating a flare, the method comprising:
forming a grain assembly comprising covering greater than about fifty percent (50%) of an entire exterior surface of an elongated grain comprising combustible material with a reactive foil comprising alternating layers of at least a first material and a second material, the first material and the second material being configured to react with one another in an exothermic chemical reaction upon ignition; and
inserting the grain assembly at least partially into a casing.

2. The method of claim 1, further comprising securing an impulse charge device to the casing, and configuring the impulse charge device to force the grain assembly out from the casing upon ignition of the impulse charge device.

3. The method of claim 2, further comprising providing an ignition assembly within the casing between the impulse charge device and the grain assembly, and configuring the ignition assembly to prevent ignition of the grain assembly until the grain assembly has been substantially ejected from the casing.

4. The method of claim 1, wherein forming a grain assembly further comprises:
providing the elongated grain with a first end, a second end, and at least one exterior lateral surface extending longitudinally between the first end and the second end; and
providing a generally planar sheet of the reactive foil; and
wherein covering greater than about fifty percent (50%) of the entire exterior surface of the elongated grain comprises wrapping at least a portion of the generally planar sheet of the reactive foil around at least a portion of the at least one exterior lateral surface of the elongated grain.

5. The method of claim 4, wherein wrapping at least a portion of the generally planar sheet of the reactive foil around at least a portion of the at least one exterior lateral surface of the elongated grain comprises causing the at least a portion of the generally planar sheet of reactive foil to substantially conform to a shape of the at least a portion of the at least one exterior lateral surface of the elongated grain.

6. The method of claim 5, wherein wrapping at least a portion of the generally planar sheet of reactive foil around at least a portion of the at least one exterior lateral surface of the elongated grain further comprises providing direct physical contact between the at least a portion of the generally planar sheet of the reactive foil and the at least a portion of the at least one exterior lateral surface of the elongated grain.

7. The method of claim 6, further comprising providing direct physical contact between at least a portion of the generally planar sheet of the reactive foil and at least a portion of at least one of the first end and the second end of the elongated grain.

8. The method of claim 4, further comprising forming the elongated grain to comprise a combustible material configured to emit a peak emission wavelength in one of the visible, ultraviolet, and infrared regions of the electromagnetic radiation spectrum upon combustion.

9. The method of claim 4, further comprising forming at least one longitudinally extending groove in the at least one exterior lateral surface of the elongated grain.

10. The method of claim 4, wherein providing the generally planar sheet of the reactive foil comprises selecting the reactive foil to include alternating layers of the at least a first material and a second material each having an average thickness of less than about 100 nanometers.

11. The method of claim 4, further comprising selecting the reactive foil to include alternating layers of a first material comprising a first element in substantially elemental form and a second material comprising an aluminide, boride, carbide, oxide, or silicide of a second element.

12. The method of claim 11, further comprising selecting the reactive foil to include alternating layers of a first material comprising aluminum and a second material comprising at least one of iron oxide, copper oxide, and zinc oxide.

13. A method of igniting an elongated flare grain, the method comprising:

forcing the elongated flare grain out from a casing; and igniting a reactive foil covering greater than about fifty percent (50%) of an entire exterior surface of the elongated flare grain, igniting the reactive foil comprising initiating an exothermic chemical reaction between alternating layers of at least a first material and a second material in the reactive foil.

14. The method of claim 13, wherein igniting the reactive foil comprises causing an explosion within an impulse charge device to force the reactive foil and the flare grain out from the casing and ignite the reactive foil.

15. The method of claim 14, further comprising preventing ignition of the elongated flare grain until the elongated flare grain has been ejected from the casing using an ignition sequence assembly.

16. The method of claim 13, wherein initiating an exothermic chemical reaction comprises initiating an exothermic chemical reaction between alternating layers of at least a first material and a second material, each layer having an average thickness of less than about 100 nanometers.

17. The method of claim 13, wherein initiating an exothermic chemical reaction comprises initiating an exothermic chemical reaction between alternating layers of a first material comprising a first element in substantially elemental form and a second material comprising an aluminide, boride, carbide, oxide, or silicide of a second, different element.

18. The method of claim 17, wherein initiating an exothermic chemical reaction comprises initiating an exothermic chemical reaction between alternating layers of a first material comprising aluminum and a second material comprising at least one of iron oxide, copper oxide, and zinc oxide.

* * * * *

UNITED STATES PATENT AND TRADEMARK OFFICE

CERTIFICATE OF CORRECTION

PATENT NO. : 7,690,308 B2
APPLICATION NO. : 12/250081
DATED : April 6, 2010
INVENTOR(S) : Daniel B. Nielson, Richard L. Tanner and Carl Dilg It is certified that error appears in the above-identified patent and that said Letters Patent is hereby corrected as shown below:

On the title page:
In ITEM (56) References Cited
OTHER PUBLICATIONS
p. 2, 2nd Column, 37th Line — change "Nanocomposite A1+MoO3" to --Nanocomposite A1+$MoO_3$--

In the specification:
COLUMN 7 LINE 23 — change "that extend" to --that extends--

In the claims:
CLAIM 5 COLUMN 10 LINE 48 — change "of reactive" to --of the reactive--
CLAIM 6 COLUMN 10 LINE 52 — change "of reactive" to --of the reactive--

Signed and Sealed this

Twenty-first Day of December, 2010

David J. Kappos

David J. Kappos
*Director of the United States Patent and Trademark Office*